US008727259B2

(12) United States Patent
Slezak

(10) Patent No.: US 8,727,259 B2
(45) **Date of Patent: *May 20, 2014**

(54) SELF-COMPENSATING FILAMENT TENSION CONTROL DEVICE WITH FRICTION BAND BRAKING

(75) Inventor: Raymond J Slezak, Barberton, OH (US)

(73) Assignee: RJS Corporation, Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/881,221

(22) PCT Filed: Feb. 9, 2011

(86) PCT No.: PCT/US2011/024163
§ 371 (c)(1),
(2), (4) Date: Apr. 24, 2013

(87) PCT Pub. No.: WO2012/108865
PCT Pub. Date: Aug. 16, 2012

(65) Prior Publication Data

US 2014/0008481 A1 Jan. 9, 2014

(51) Int. Cl.
*B65H 59/04* (2006.01)

(52) U.S. Cl.
USPC ..... 242/421.8; 242/422.8; 242/156.2

(58) Field of Classification Search
USPC ..... 242/416, 421, 421.5, 421.8, 422, 422.4, 242/422.8, 156, 156.2
See application file for complete search history.

(56) References Cited

U.S. PATENT DOCUMENTS

| | | | | |
|---|---|---|---|---|
| 3,540,675 | A | 11/1970 | Goldworthy | 242/156.2 |
| 3,899,143 | A | 8/1975 | Slezak | 242/156.2 |
| 4,004,750 | A | 1/1977 | Seagrave, Jr. | 242/75.43 |
| 6,435,445 | B1 * | 8/2002 | Slezak | 242/421.9 |

FOREIGN PATENT DOCUMENTS

| | | | |
|---|---|---|---|
| JP | 60048872 | 3/1985 | B65H 77/00 |
| WO | WO 02/00540 A2 | 1/2002 | B65H 59/04 |

OTHER PUBLICATIONS

International Search Report mailed Jun. 24, 2011 in corresponding application No. PCT/US2011/024163.
Written Opinion mailed Jun. 24, 2011 in corresponding application No. PCT/US2011/024163.
International Preliminary Report on Patentability mailed Jan. 11, 2013 in corresponding application No. PCT/US2011/024163.

* cited by examiner

*Primary Examiner* — William E Dondero
(74) *Attorney, Agent, or Firm* — Renner Kenner Greive Bobak Taylor & Weber

(57) ABSTRACT

A self-compensating tension control device for regulating the withdrawal of filamentary material from a spool includes a fixed support that maintains an inverted cam surface and a spindle assembly rotatably carrying the spool. A tension force applied to the filamentary material, in opposition to a biasing force, moves the spindle assembly linearly in relation to the fixed support. A braking mechanism includes a brake drum rotatable with the spindle assembly, a friction band adapted to engage the brake drum and a rocker arm that engages the cam surface. When the tension force applied to the filamentary material is reduced and unable to overcome the biasing force, the cam roller engages the cam surface and causes the friction band to generate a braking force on the brake drum. Withdrawal of the filamentary material at a regular rate occurs when the biasing force is balanced with the tension force.

13 Claims, 16 Drawing Sheets

SELF-COMPENSATING FILAMENT TENSION CONTROL DEVICE WITH FRICTION BAND BRAKING

CROSS-REFERENCE TO RELATED APPLICATION

This is a §371 application of International patent application number PCT/US2011/024163 filed Feb. 9, 2011, and which is incorporated herein by reference.

TECHNICAL FIELD

The present invention relates generally to an automatic tension control device for regulating the amount of tension under which a filamentary material is withdrawn from a spool. More particularly, the present invention relates to such a tension control device which tends to maintain substantially constant tension in filamentary materials over variances in operating parameters. More specifically, the present invention relates to such a tension control device which employs a laterally movable spindle carriage operative with a cam-actuated friction band brake, thereby tending to maintain substantially constant tension in the filament.

BACKGROUND ART

Filamentary materials include fibers in single and multiple strands, flat bands, or tubing produced in long lengths and conveniently wound on spools. The various filamentary materials may be either natural or synthetic fibers, glass or metal. Such materials are commonly utilized as reinforcements for plastic or elastomeric compounds or may themselves be fabricated into integral items as in the textile industry or the tire industry. Regardless of the application, it is customary to withdraw the filamentary material from the spool at or near the location it is being used. To facilitate such removal, the spool is customarily mounted on a spindle or let-off device which permits the spool to rotate as the filament is withdrawn.

A main function of a tension control device is to provide a uniform tension of the filament as it is withdrawn from the spool. This requirement applies also when the weight and diameter of the filament wound upon the spool decreases as the filament is consumed, and/or if the speed of withdrawal is changed. Furthermore, it is necessary that in a system employing multiple tension control devices that the withdrawal tension be substantially uniform among all devices. Another function of the device is to apply additional tension (or braking) when withdrawal is stopped, thereby minimizing unraveling of the filament on the spool because of the momentum of spool and its content. Such braking, in the stopped condition, also may serve to keep the spindle rotationally stable during loading of spools thereon.

Numerous braking devices have been developed for use with creels. Many of these provide for the filament to be payed out under tension greater than what is required for payout or withdrawal from the spool. As the tension decreases, with slack in the filament, the braking force is applied to slow the rotation of the spool. Further, the amount of tension to be maintained in the filament must be variable in order to accommodate operations with different filaments under various conditions. In the past, such creels having variable tension control have often required multiple individual adjustments and have not been desirably compact. Some designs have even required tension adjustments during payout or withdrawal of the filament, as the spool is emptied. In other instances, creels have exhibited undesirable hunting or loping in the form of periodic variations about a desired tension, particularly in high-tension applications.

One of the more commercially successful tension control devices used in the tire industry is in accordance with Applicant's U.S. Pat. No. 3,899,143. That device has a support structure which carries a spool support and a separately mounted rotatable pivot shaft. A first lever arm fixed on the pivot shaft carries a guide for tensioning the filamentary material as it is withdrawn from a spool mounted on the spool support and a brake which selectively engages the spool support. A second lever arm fixed on the pivot shaft is operatively connected with an air cylinder which effects a biasing that is transmitted to the first lever arm via the pivot shaft.

Tension control devices according to U.S. Pat. No. 3,899,143 have demonstrated exemplary operating characteristics under a variety of conditions and with a variety of filaments. However, there are several situations in which these tension control devices are not well suited. It has been found that the control arm and guide roller are vulnerable to damage from over-tension possibly caused by entanglement of the spooled material. In instances where the filamentary material is a heavy gauge wire, the guide roller imparts a "cast" or distortion to the shape of the wire. This may lead to a less than satisfactory end product or the need to provide additional manufacturing equipment to straighten the wire. To the present time, there has been no comprehensive device for adequately dispensing heavy filamentary material from a spool. Yet a third problem is that the control arm and roller inhibits closely mounting the multiple tension controllers on the creel assembly.

One way to overcome the foregoing problems associated with the prior art is to provide a tension control device in which the spool is carried by a pivotably mounted spindle assembly that is moveable with a pivotably mounted braking assembly as seen in U.S. Pat. No. 6,098,910. By utilizing a fixed cam that engages the braking assembly, the rotation of the spindle is inhibited whenever a predetermined tension force is absent from the filamentary material. The braking assembly is provided with a slidable block with cam bearings that are spring-biased against a curvilinear cam surface provided by the cam. This provides a gradual yet firm application or removal of a braking force depending upon the amount of tension applied to the filamentary material. The braking force, applied through the cam, adjusts in response to the varying tension of the material as it unwinds from the spool. An increasing tension accordingly acts on the pivotably mounted spindle assembly causing the braking force to be relieved by an increasing amount, thereby tending to keep the filament in constant tension; conversely, a decreasing tension causes a greater braking force to be applied, with full braking (within the limits of the device) at zero tension. Although an improvement in the art, the aforementioned tension control devices with a pivotably mounted spindle utilize a pendulum motion to provide displacement of the spindle and spool. However, such pendulum motion imparts the effect of gravity on the operating tension because the force from gravity varies according to the angular displacement. As a result, the force from gravity can be several times the desired tension output of the device.

It is also known in the art to use a magnetic eddy current brake to provide back tension of a spool from which filamentary material is withdrawn. In one known device, an eddy current disk rotates with the spool and a control arm is pivotally mounted near the spool. The filamentary material passes over a guide roller mounted to one end of the control arm. An opposite end of the control arm carries the magnetic material. The tension in the filamentary material is defined over the force to pivot or move the control arm. The amount of this force can be adjusted by a pressurized diaphragm cylinder. If the filament's tension exceeds the control arm force, then the magnetic brake material moves away from the eddy current disk and the braking force on the spool is reduced. If the filament's tension is less than the control arm force and that of the diaphragm, then the magnetic brake material moves toward the eddy current disk and the braking force on the spool is increased. However, the use of a control arm has the problems previously mentioned of imparting distortion to the filamentary material, damaging the guide roller from over-tension and preventing such devices from being closely mounted to one another on the creel assembly.

In view of the shortcomings of the aforementioned devices, there remains a need in the art for a tension control device that minimizes the force from gravity while still providing the benefits of a device that does not employ a control arm and guide roller.

DISCLOSURE OF INVENTION

In light of the foregoing, it is a first aspect of the present invention to provide a self-compensating filament tension control device with friction braking.

Another aspect of the present invention is to provide a self-compensating tension control device for regulating the withdrawal of filamentary material from a spool, comprising a fixed support, the fixed support maintaining a cam surface, a spindle assembly carried by the fixed support, the spindle assembly rotatably carrying the spool of filamentary material, wherein a tension force applied to the filamentary material, in opposition to a biasing force, causes the spindle assembly to linearly move in relation to the fixed support, and a braking mechanism comprising a brake drum rotatable with the spindle assembly, a friction band adapted to engage the brake drum, and a rocker arm having a cam roller engageable with the cam surface at one end and at an opposite end a bracket associated with the friction band, wherein when the tension force applied to the filamentary material is reduced and unable to overcome the biasing force, the cam roller engages the cam surface and causes the bracket and the friction band to generate a braking force on the brake drum, and wherein withdrawal of the filamentary material at a regulated rate occurs when the biasing force is balanced with the tension force.

BRIEF DESCRIPTION OF THE DRAWINGS

This and other features and advantages of the present invention will become better understood with regard to the following description, appended claims, and accompanying drawings wherein:

BEST MODE FOR CARRYING OUT THE INVENTION

Figure 1:
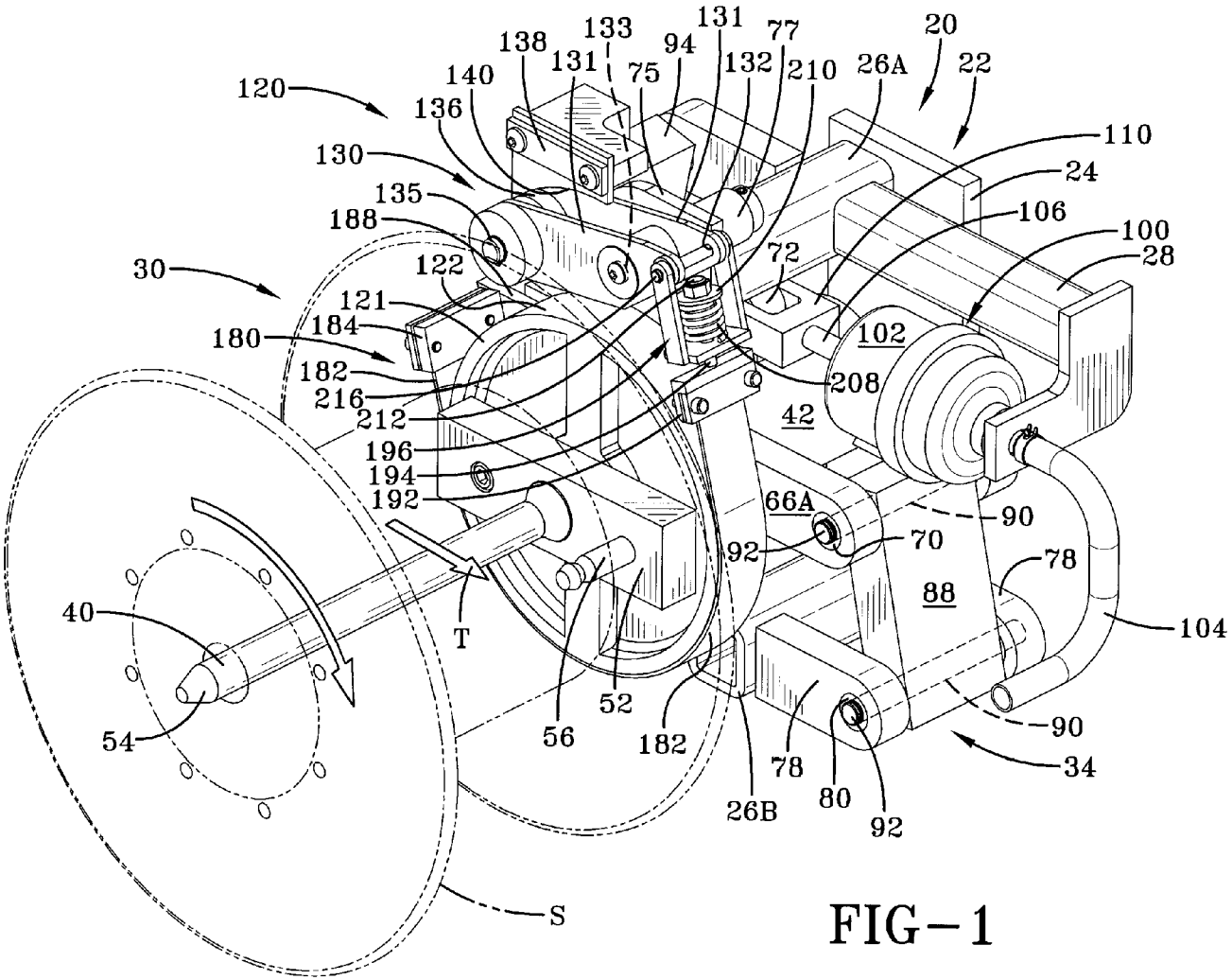
FIG. 1 is a front isometric view of a self-compensating filament tension control device with friction band braking shown in a braking position embodying the concepts of the present invention, wherein a spool of filamentary material is shown in phantom and wherein the device controls withdrawal tension of the filamentary material.

An exemplary self-compensating filament tension control device with friction band braking according to the concepts of the present invention is generally indicated by the numeral 20 as seen in FIGS. 1-8. The tension control device 20 includes a fixed support 22 that is affixed to or is part of a creel or other support structure which is part of a machine that processes individual strands of filamentary material into a finished manufactured item. It will be appreciated that the creel likely supports multiple devices 20 as needed. The fixed support 22 includes a support frame 24 which is mounted on the creel via bolts, welding or other secure attachment. The support frame 24 includes an upper support arm 26A and a lower support arm 26B extending substantially perpendicularly therefrom and wherein the support arms 26 are utilized to support or carry other components of the control device 20. A diaphragm actuator bracket 28 extends perpendicularly and outwardly from the upper support arm 26A, but in some embodiments may extend directly from the frame 24.

A spindle assembly, designated generally by the numeral 30, is carried by the fixed support 22 in conjunction with a straight-line mechanism designated generally by the numeral 34. The interrelationship between the spindle assembly 30 and the straight line mechanism 34 will be discussed in detail as the description proceeds.

The spindle assembly 30 carries a spool S of filamentary material that is pulled so as to result in rotational movement of the spool. As shown in FIG. 1, the filamentary material is pulled to the right of the device, as designated by capital letter T, resulting in clockwise rotation of the spool S. In other words, tension (T) is applied to the filamentary material causing the spool to rotate. Skilled artisans will appreciate that the filament may be pulled off in the other direction resulting in counter clockwise rotation of the spool as long as appropriate modifications are made to components of the control device 20 to allow for such a configuration, or if the entire device is mounted upside down.

Figure 7:
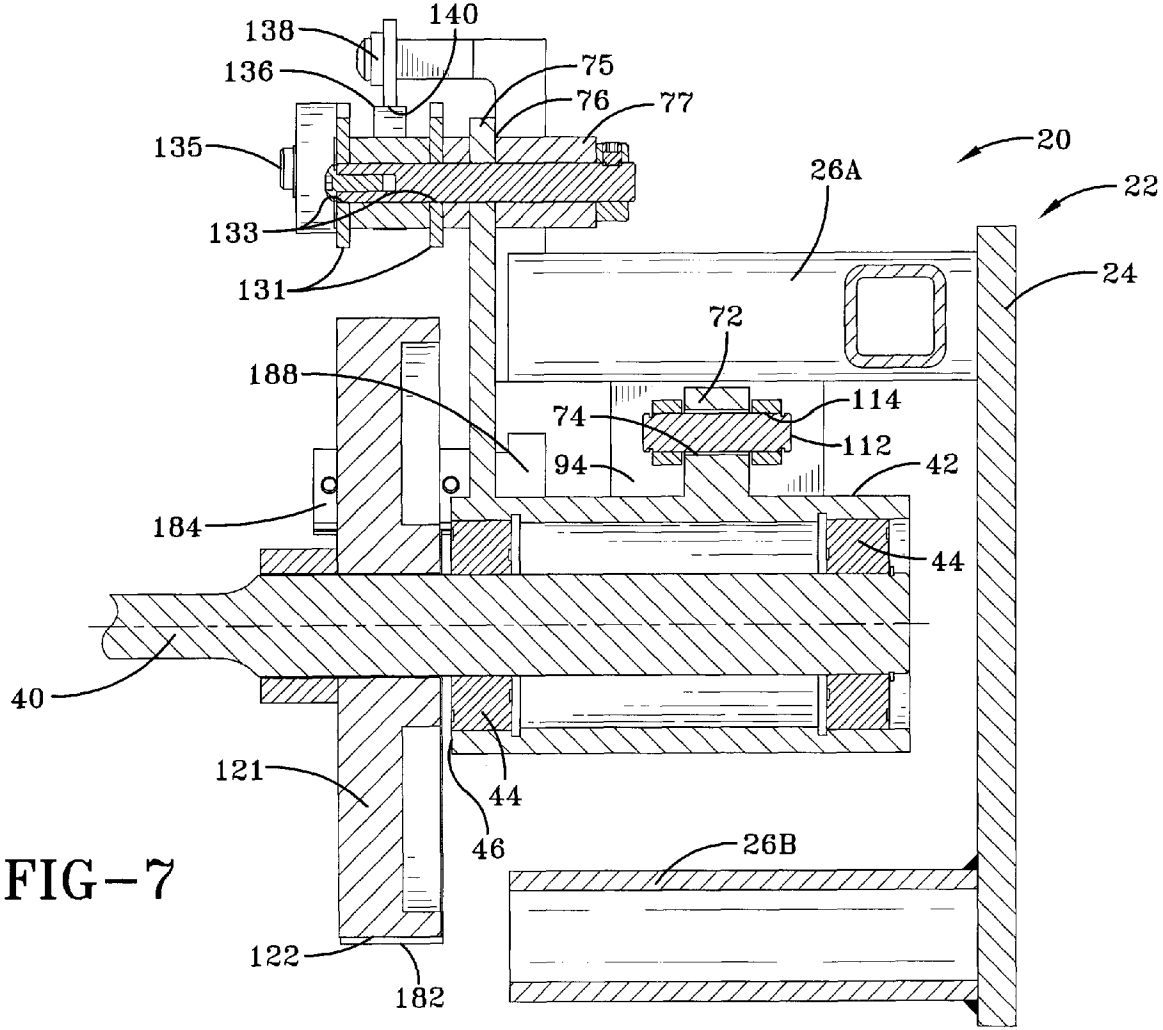
FIG. 7 is a partial cross-sectional view of the tension control device taken along line 7-7 of FIG. 5.
Figure 8:
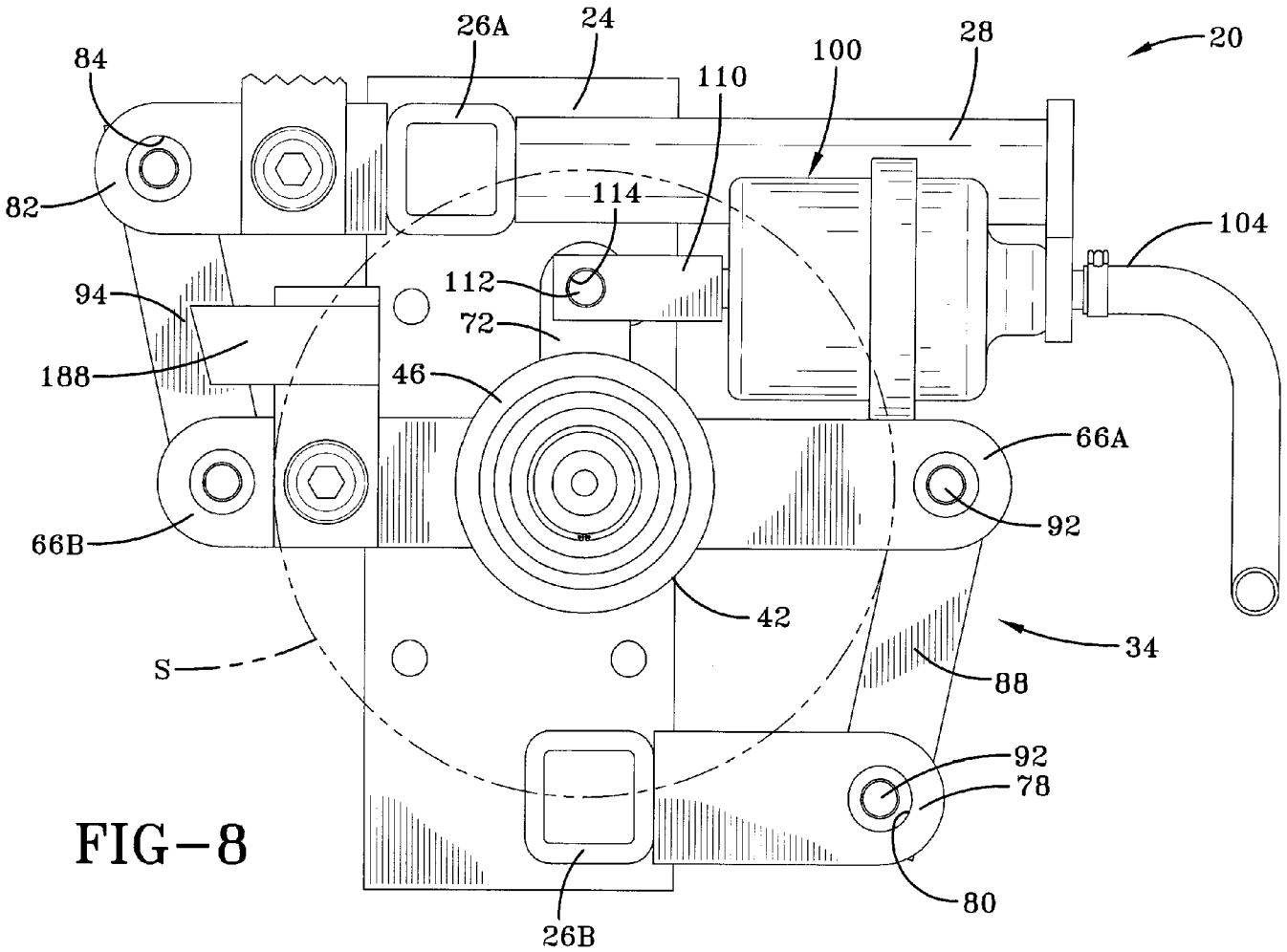
FIG. 8 is a front elevational sectional view of the tension control device with the spool removed taken along line 8-8 of FIG. 4 so as to show a straight-line mechanism which allows lateral movement of a spindle assembly into and out of relationship with the friction band braking system according to the concepts of the present invention.
Figure 9:
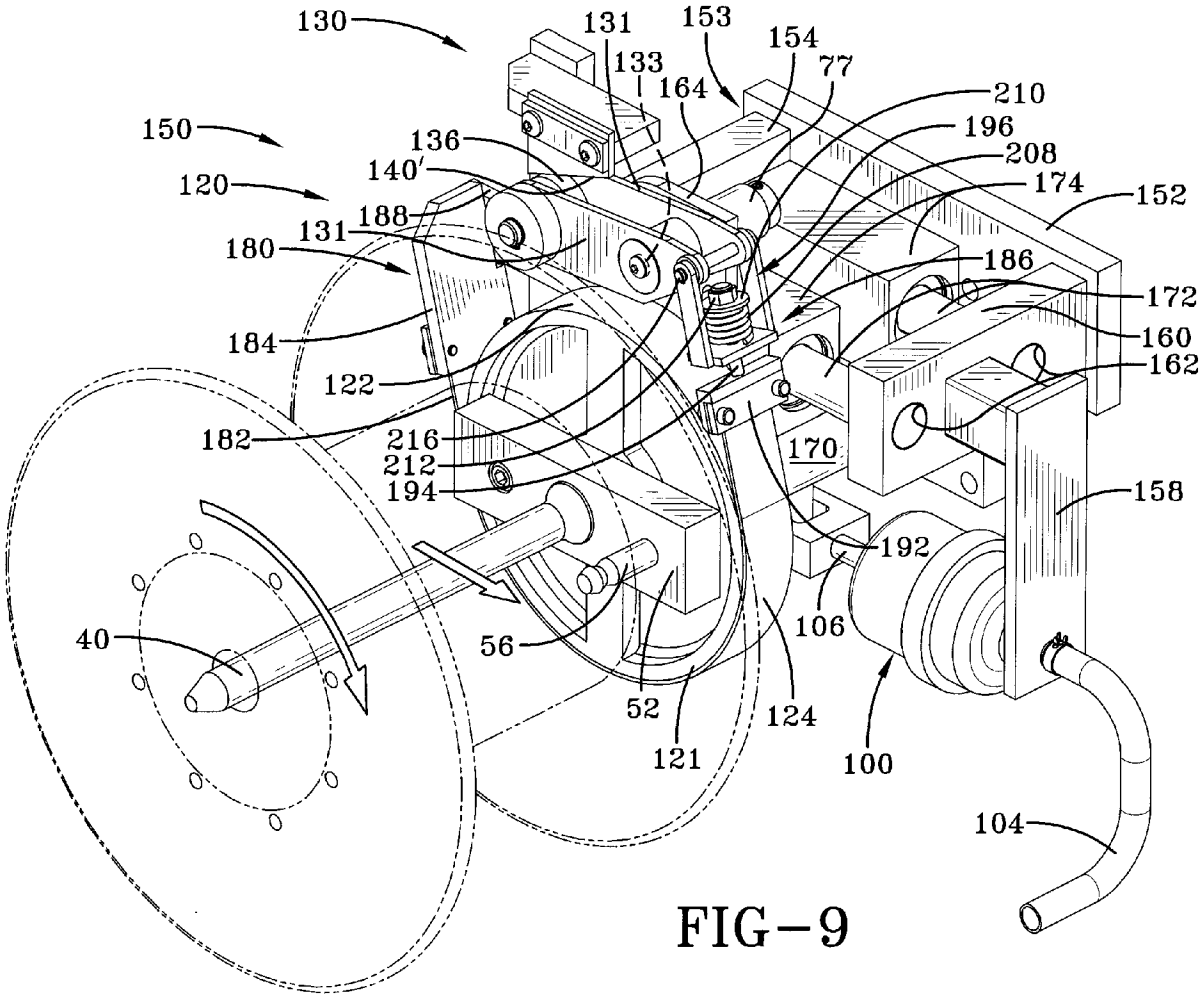
FIG. 9 is a front isometric view of an alternative self-compensating filament tension control device with friction band braking shown in a braking position embodying the concepts of the present invention, wherein a spool of filamentary material is shown in phantom and wherein the device controls withdrawal tension of the filamentary material.
Figure 10:
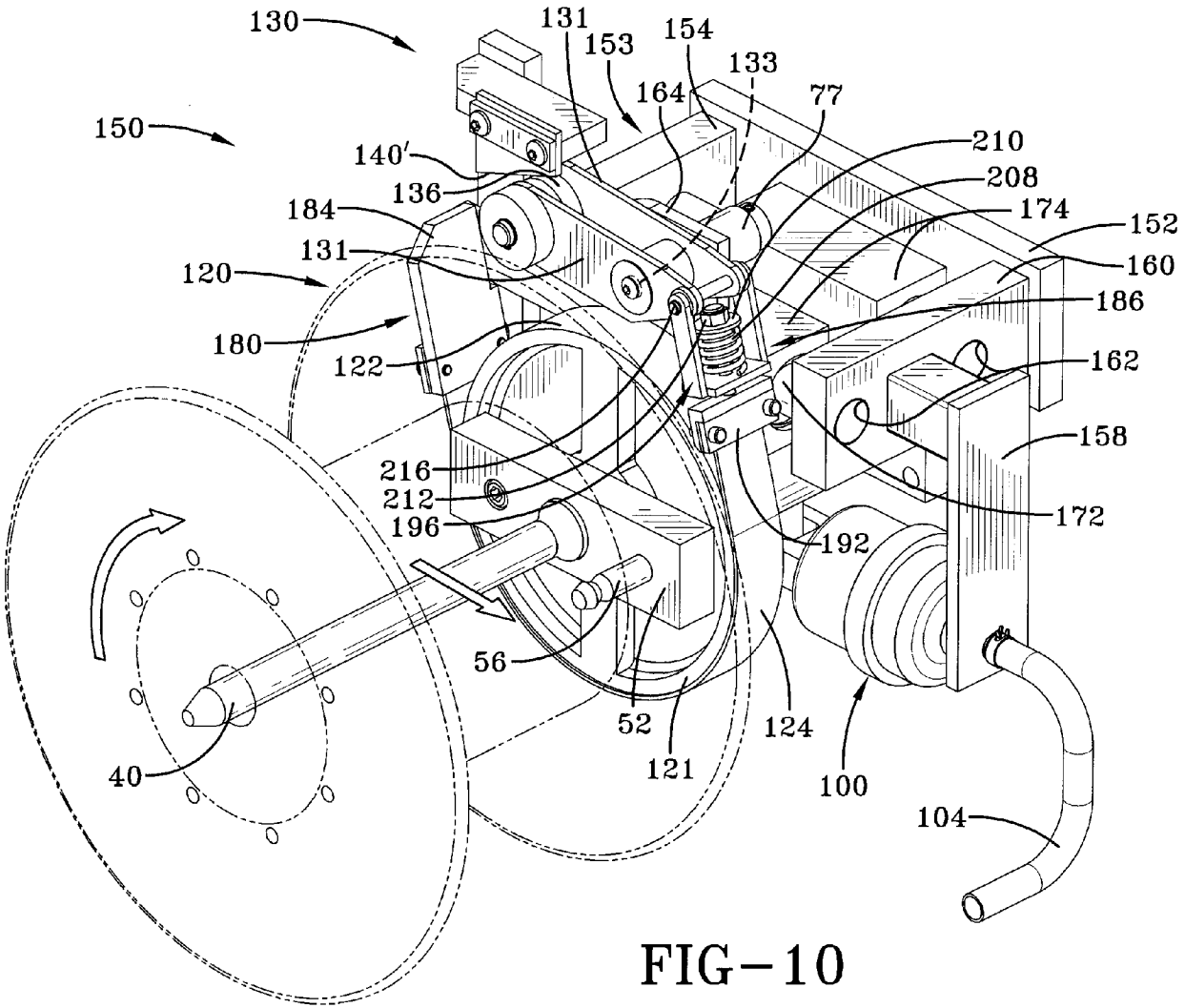
FIG. 10 is a front isometric view of the alternative tension control device showing the device in a non-braking position.
Figure 11:
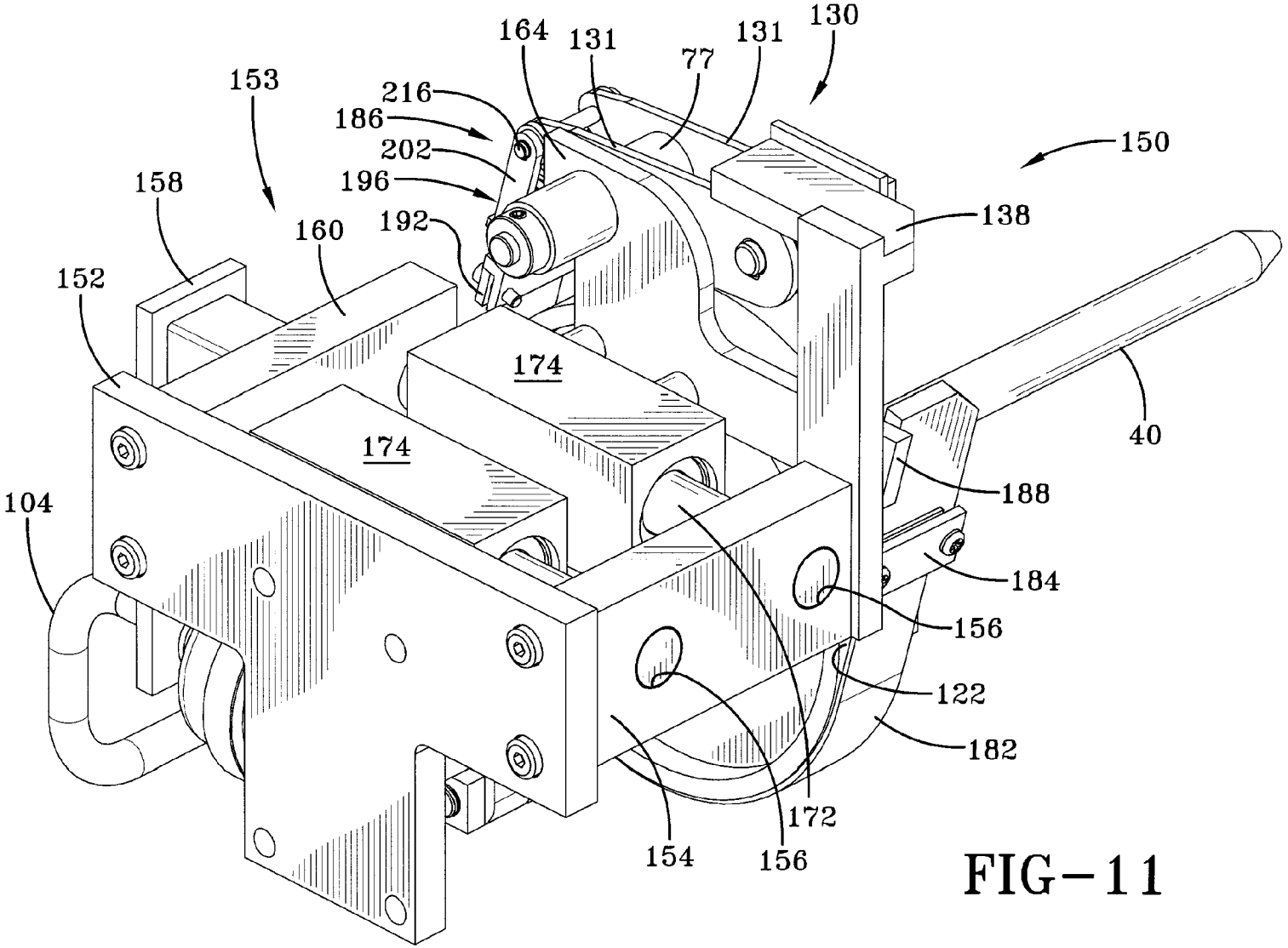
FIG. 11 is a rear isometric view of the alternative tension control device showing the device in a non-braking position.
Figure 12:
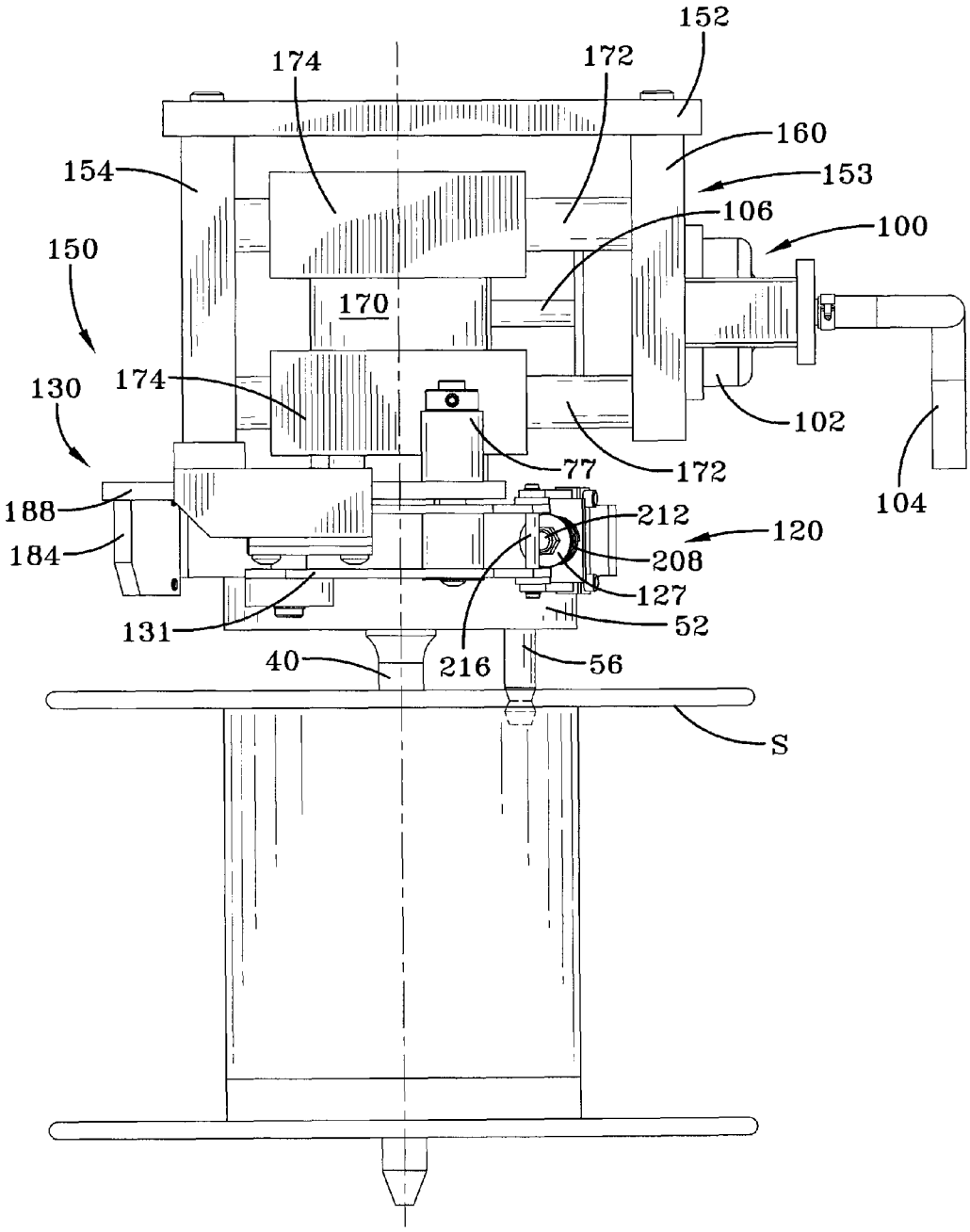
FIG. 12 is a top view of the alternative tension control device.
Figure 13:
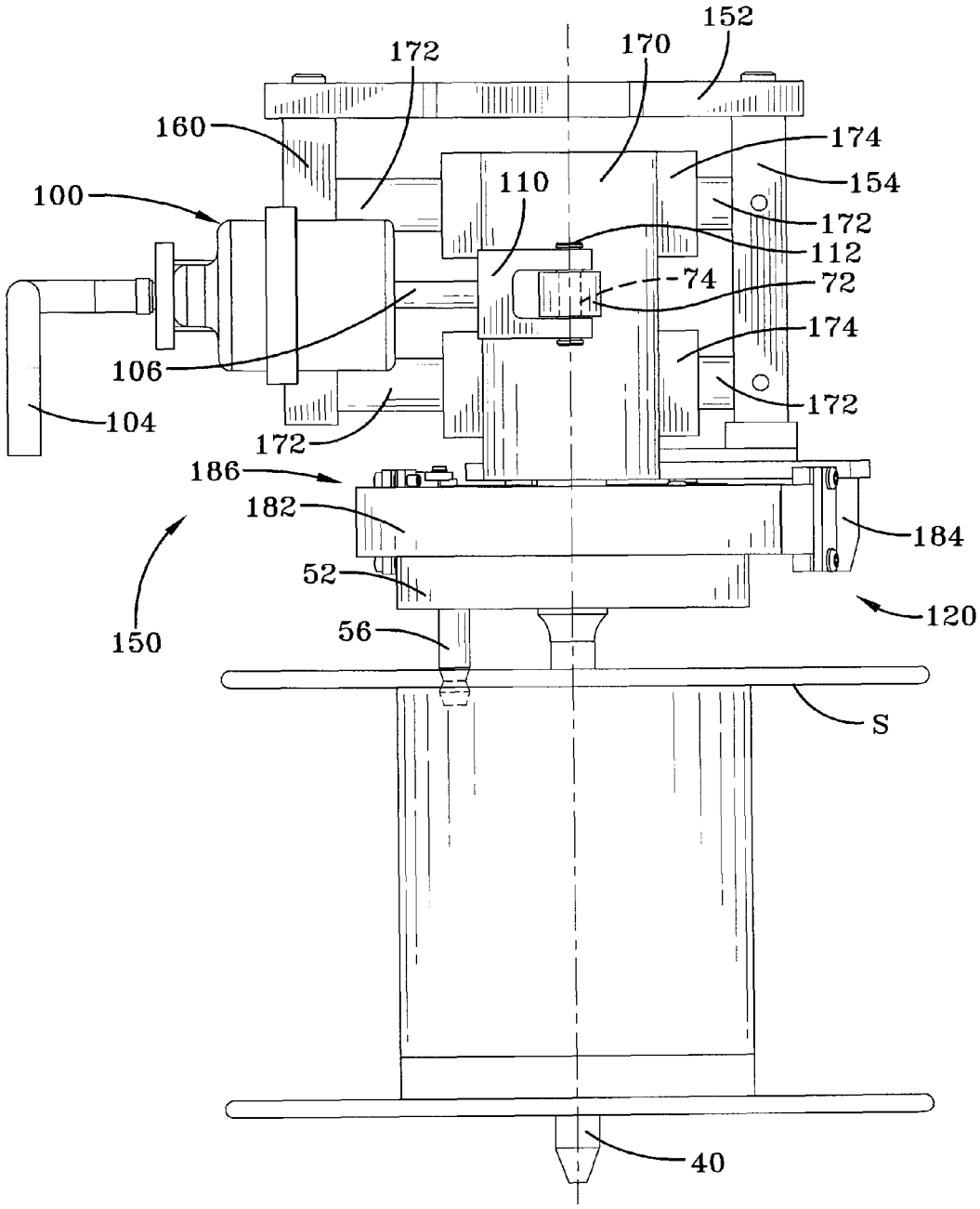
FIG. 13 is a bottom view of the alternative control device.
Figure 14:
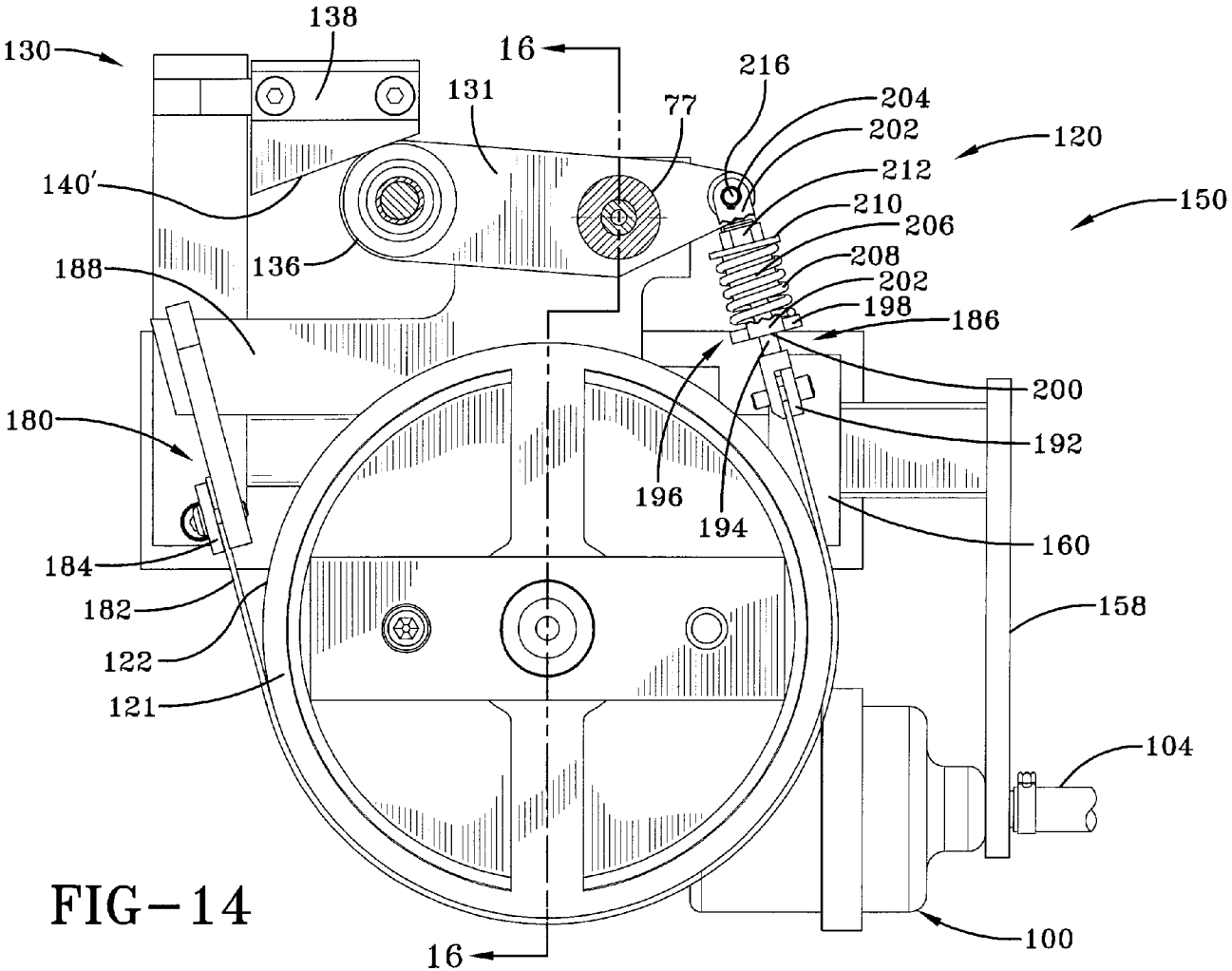
FIG. 14 is an elevational view of the alternative tension control device in a non-braking position, partially broken away.
Figure 15:
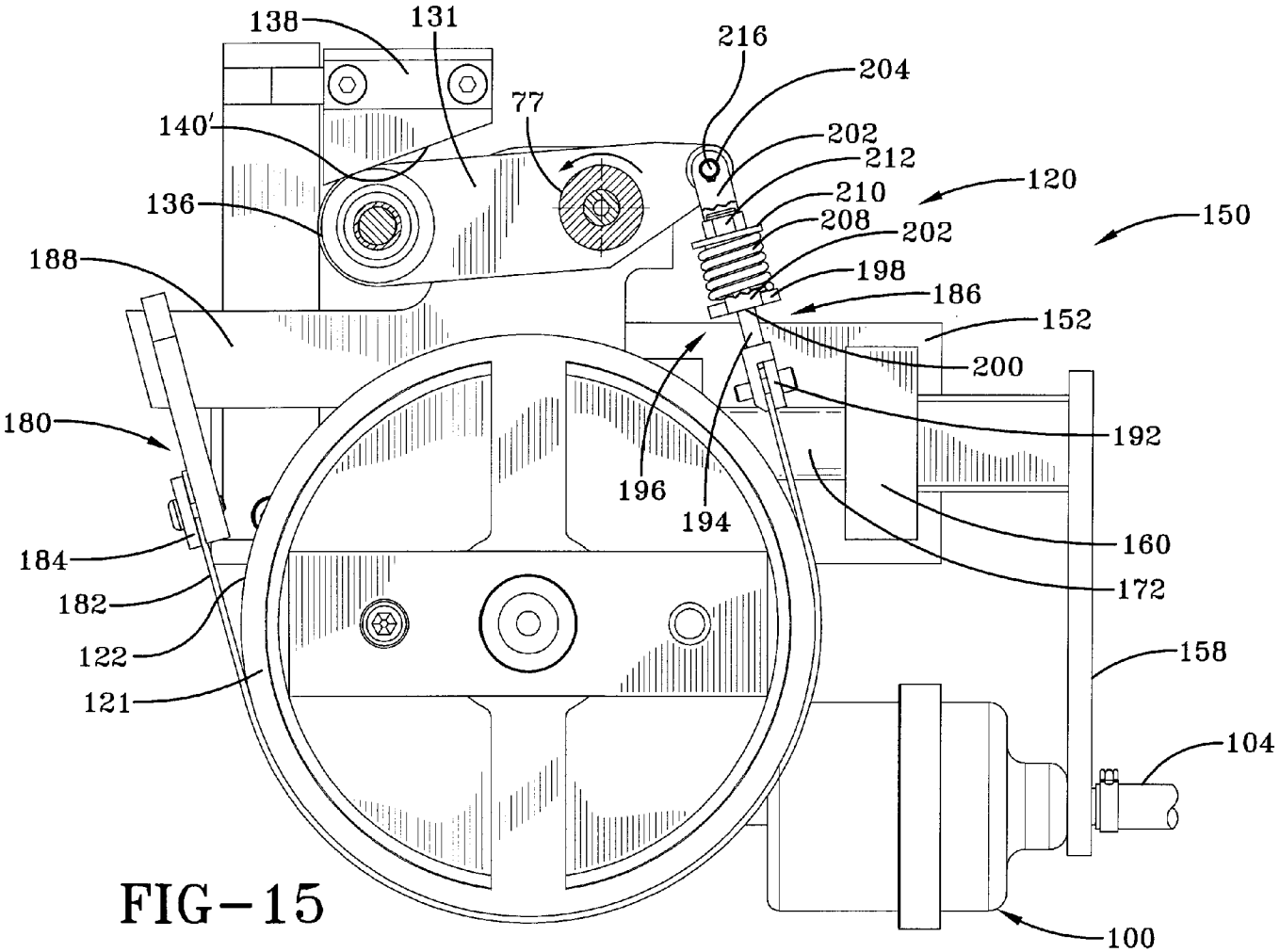
FIG. 15 is an elevational view of the alternative tension control device in a braking position, partially broken away.
Figure 16:
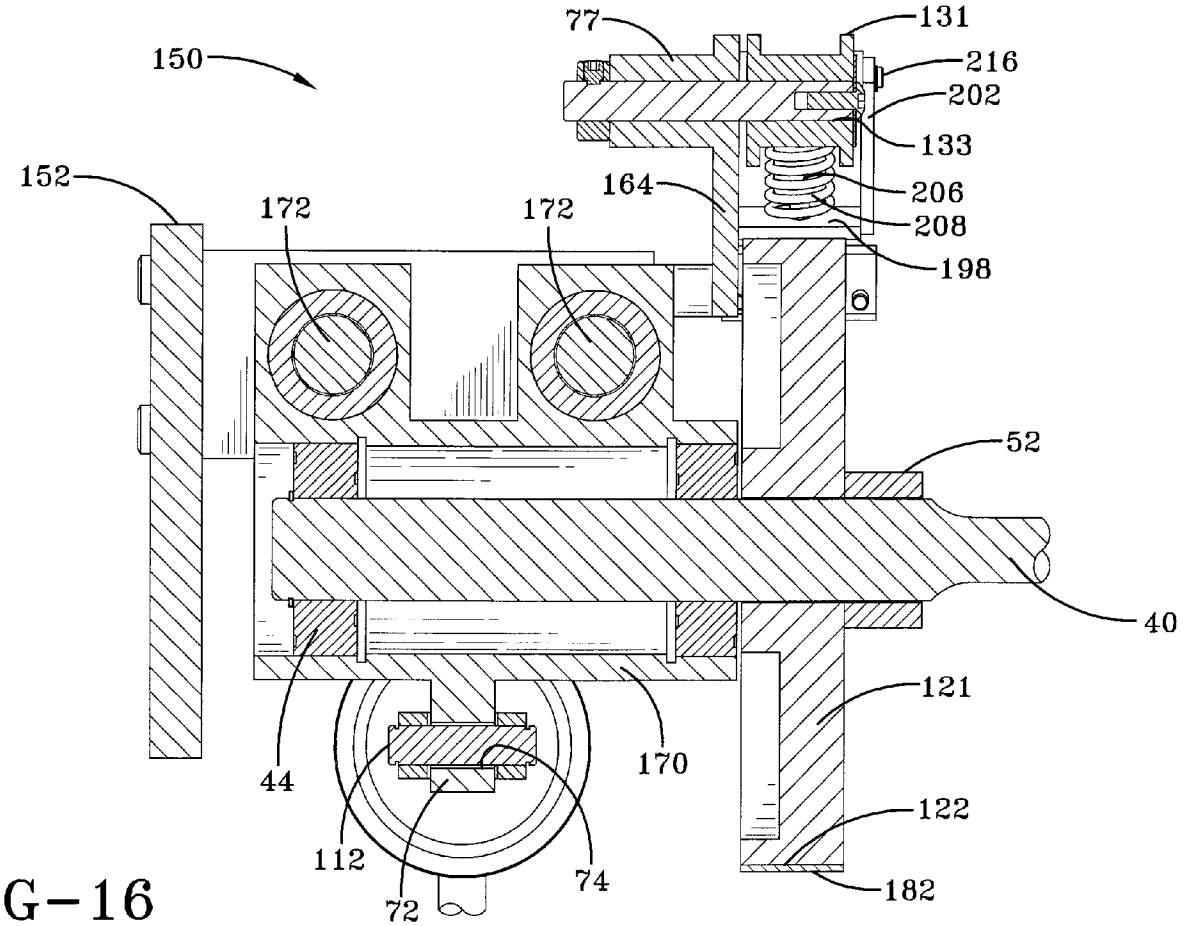
FIG. 16 is a cross-sectional view of the alternative tension control device, partially broken away, taken along line 16-16 of FIG. 14 showing elements of the friction braking system and a linear ball bushing mechanism which allows lateral movement of a spindle assembly into and out of relationship with a friction band braking system according to the concepts of the present invention.

The spindle assembly 30 includes a spindle 40 which is rotatably received in a carriage 42 and which axially extends therefrom. As best seen in FIG. 7, bearings 44 are interposed between the spindle 40 and the carriage 42 to allow for rotatable movement of the spindle 40. As seen in FIGS. 1-4, the carriage 42 includes a brake end 46. Proximal the brake end 46, a drive plate 52 is attached to and rotates with the spindle 40 which axially extends therethrough. The spindle has a tapered end 54 to allow for easy loading of the spool S. A drive pin 56 extends from the drive plate 52 in the same direction as the spindle and is radially displaced from the spindle 40. The drive pin 56 is received in an interior portion or hub of the spool and facilitates transfer of rotational and braking forces between the spool and the spindle assembly. In other words, as the filament is drawn or pulled off of the spool, as tension is applied, the rotational forces imparted to the spool are transmitted to the drive pin 56, the drive plate 52 and the spindle 40. Likewise, as will be described, braking forces applied to the spindle are transmitted through the drive plate, the drive pin and the spool to slow or stop rotation of the spool.

As best seen in FIGS. 1-3 and 8, the carriage 42 includes a pair of front carriage arms 66A/B and a pair of rear carriage arms 68A/B which extend radially from each side of the carriage. The carriage arms 66, 68 are provided at front and rear ends of the carriage and suffixes are employed to designate which carriage arm is in proximity to other features of the tension control device. Specifically, a front carriage arm 66A is disposed near a loading assembly of the device while a front carriage arm 66B is disposed near an opposite side of the device. In a corresponding manner, a rear carriage arm 68A is near the loading assembly side while a rear carriage arm 68B is near the opposite side. Each carriage arm 66A/B and 68A/B is provided with a carriage arm hole 70 extending therethrough. It will be appreciated that the carriage arms 66A and 66B extend in opposite directions from one another and are oriented about 180° apart. Carriage arms 68A and 68B also extend away from one another. As a result, the carriage arms extend radially from the carriage 42 to become part of the straight line mechanism 34. Extending radially from a top side of the carriage 42 and approximately 90° away from either pair of carriage arms is a nose 72. Extending through the nose 72 is a nose hole 74, as best seen in FIG. 7.

A carriage flange 75 extends substantially perpendicularly from the carriage. Specifically, the flange 75 extends from a top side of the carriage 42 and proximally in between the front carriage arms 66. Extending through the flange 75 is a pivot pin hole 76 which receives a pivot pin 77 that extends from both sides.

The straight line mechanism 34 interconnects the carriage arms 66A/B and 68A/B to the support arms 26A and 26B. As will become apparent as the description proceeds, the straight line mechanism allows for linear movement of the spindle 40. In particular, variations in a tension force applied to the filamentary material move the spindle 40 substantially horizontally and linearly side to side in relation to the fixed support. The straight line mechanism 34 includes a pair of lower arm tabs 78 which are spaced apart and extend substantially perpendicularly from the support arm 26B. Each tab 78 has a tab hole 80 extending therethrough which is aligned with one another. The mechanism 34 also includes a pair of spaced apart upper arm tabs 82 that are spaced apart from one another and extend substantially perpendicularly from the support arm 26A. Each tab 82 includes a tab hole 84 which is substantially aligned with one another.

Interconnecting the tabs 78 to the carriage arms 66A and 68A, and the tabs 82 to the carriage arms 66B and 68B are link arms. Specifically, a lower link arm 88 includes a pair of link arm holes 90 extending cross-wise through each end thereof Each link arm hole 90 is aligned with the tab holes 80 and receives a link pivot pin 92 therethrough. The other end of the link arm 88 is connected to the carriage arms 66A and 68A wherein a pivot pin 92 extends through the corresponding link arm hole 90 and the arm holes 70. In a similar manner, an upper link arm 94 connects the carriage arms 66B and 68B to the tab arms 82. The link arm 94 has link arm holes 96 extending cross-wise through each end thereof One link arm hole 94 is aligned with the carriage arm holes 70 so as to receive a pivot pin 98. The other end of the lower link arm 94 is connected to the lower arm tabs 82 and their respective tab holes 84 via a link pivot pin 98 which extends through the other link arm hole 96. Skilled artisans will appreciate that use of the link arms 88 and 94 to interconnect the carriage arms 66A,B and 68A,B to the upper and lower arm tabs 78 and 82 form the straight line mechanism 34 which allows for the spindle assembly 30 to move from side to side. It will further be appreciated that this movement is substantially linear at the spindle 40.

A loading assembly 100 is utilized to generate a biasing force to initially position the linear relationship of the spindle assembly 30 with respect to the braking mechanism as will be discussed. In particular, the loading assembly includes a diaphragm actuator 102 wherein one end is mounted to the diaphragm actuator bracket 28. One end of an air tube 104 is connected to the diaphragm actuator 102 and the opposite end is connected to a pressurized air system (not shown). A piston rod 106 extends from the end of the diaphragm actuator 102 opposite the air tube and is connected to a clevis 110 which interfits with the nose 72. The clevis 110 has a nose end hole 114 which is aligned with the nose hole 74 wherein a clevis pin 112 extends through the nose end hole 114 and the nose hole 74 so as to connect the rod 106 to the carriage 42. A predetermined amount of pressure is applied via the air tube 104 through the diaphragm actuator 102 so as to extend the piston rod 106 outwardly and move the spindle assembly 30 into a braking position as will be described. Other biasing forces could be generated by gravity or a tilted orientation of the spindle assembly and/or straight-line mechanism with respect to the fixed support.

Figure 5:
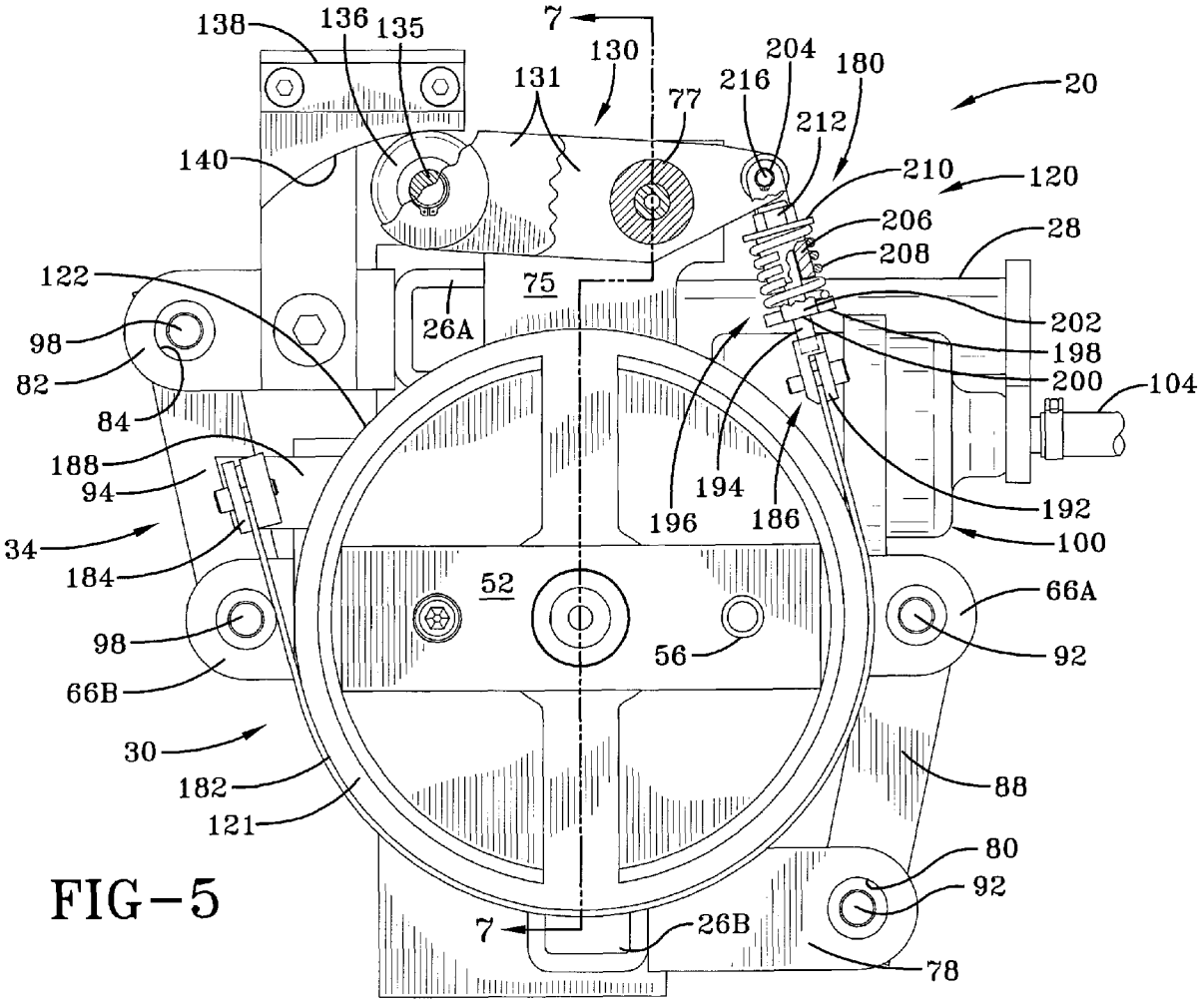
FIG. 5 is an elevational view of the tension control device in a non-braking position, partially broken away.
Figure 6:
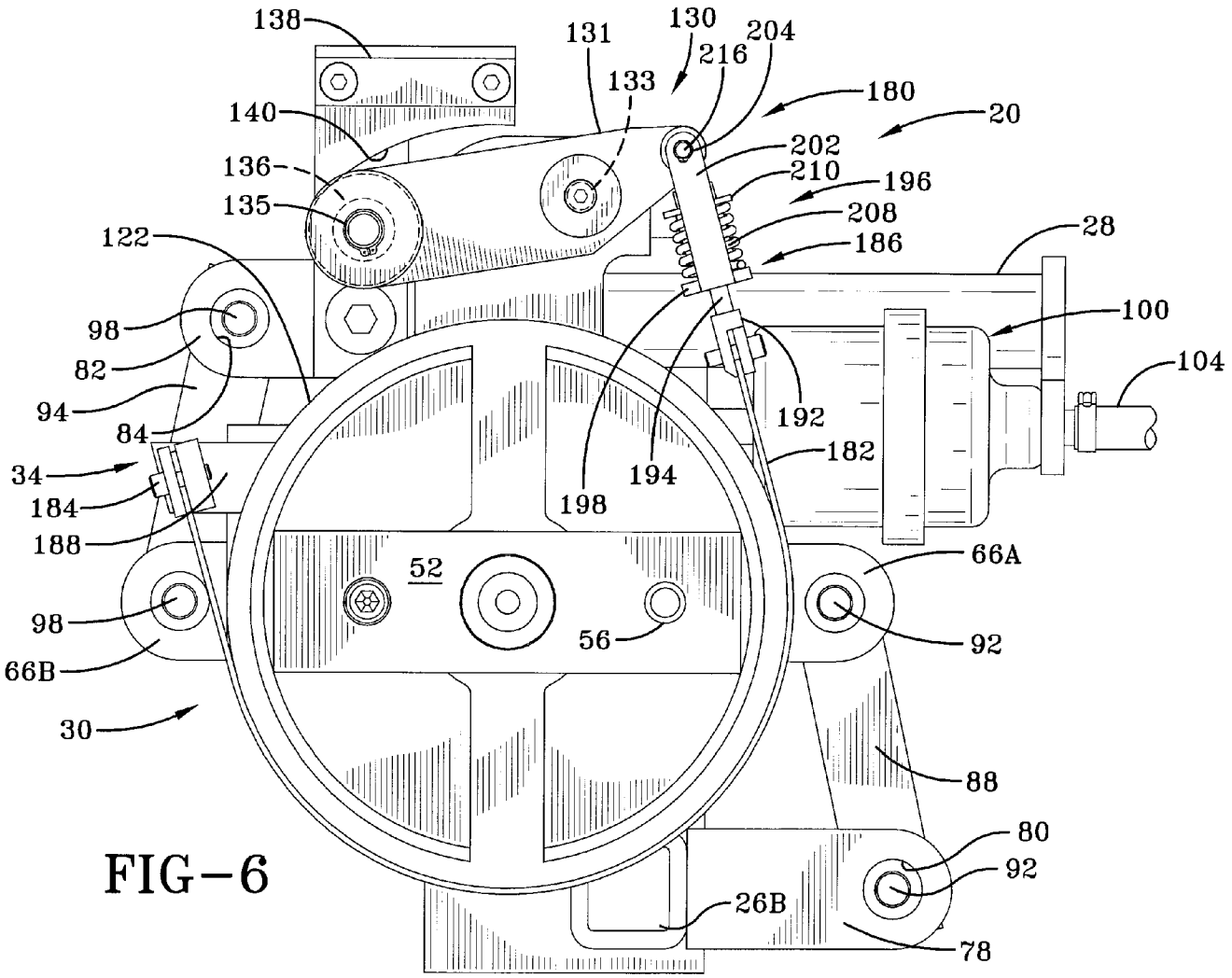
FIG. 6 is an elevational view of the tension control device in a braking position.

A braking mechanism 120 is primarily connected to and carried by the upper arm tab 82 furthest from the support plate 24 and the support arm 26A. The mechanism 120 is also supported by the flange 75 through the pivot pin 77. The mechanism 120 is also coupled to the carriage through the spindle as will be described. The braking mechanism 120 includes a circular brake drum 121 which rotates with and is connected to the spindle 40 and the drive plate 52. The drum 121 provides a relatively smooth outer diameter braking surface 122. Associated with the braking mechanism 120 is a band assembly designated generally by the numeral 180. The band assembly 180 includes a friction band 182 which has a fixed end clamp 184 and a bias end 186. In the present embodiment the friction band 182 is in about 180° contact with the braking surface 122. In other embodiments more or less contact can be obtained by adjusting the position of the fixed end 184. As best seen in FIGS. 5 and 6, but also shown throughout FIGS. 1-8, the fixed end 184 is secured to the carriage 42 or other components connected to the carriage. Specifically, a flange 188 extends from the carriage 42 and the fixed end clamp extends perpendicularly therefrom. The bias end 186 includes a clamp 192 that secures the opposite end of the friction band 182. Extending from the clamp 192 is a stem 194 which slidably receives thereon a U-bracket 196.

The U-bracket 196 includes a base 198 having a stem hole 200 therethrough that slidably receives the stem 194. Extending from each end of the base 198 in a substantially parallel configuration is a side 202. A pin hole 204 extends through each side 202 at an end opposite the base 198. A slidable sleeve 206 is disposed over the stem 194 and is slightly shorter in height than the U-bracket sides 202. A spring 208 is disposed over and around the sleeve 206 and is supported by the base 198. In an uncompressed condition, the spring 208 is of a longer length than the sleeve 206. A washer 210 is disposed over the spring 208 and received on to the stem 194, and is secured in place by a nut 212 that is secured to the end of the stem 194. A bracket pin 216 extends through the pin holes 204 and connects the U-bracket to the other parts of the braking mechanism 120 as will be discussed.

A rocker arm 130 is another part of the braking mechanism 120 and couples the fixed support to the carriage assembly. In particular, the rocker arm 130 includes a pair of opposed rocker plates 131 which are spaced apart and parallel with one another. At one end of the rocker plates is a pair of aligned collar pin holes 132 which rotatably receive respective ends of bracket pin 216. The rocker plates 131 also include a pair of aligned pivot holes 133 which receive the pivot pin 77. The pivot pin 77 is supported by the bracket 75 and allows the rocker arm to pivot. Each rocker plate 131 also provides a roller hole 135 that is aligned with each other and is located at the opposite end of the collar pin holes 132. A cam roller 136 is carried by the roller holes 135 and disposed between the plates 131.

Figure 2:
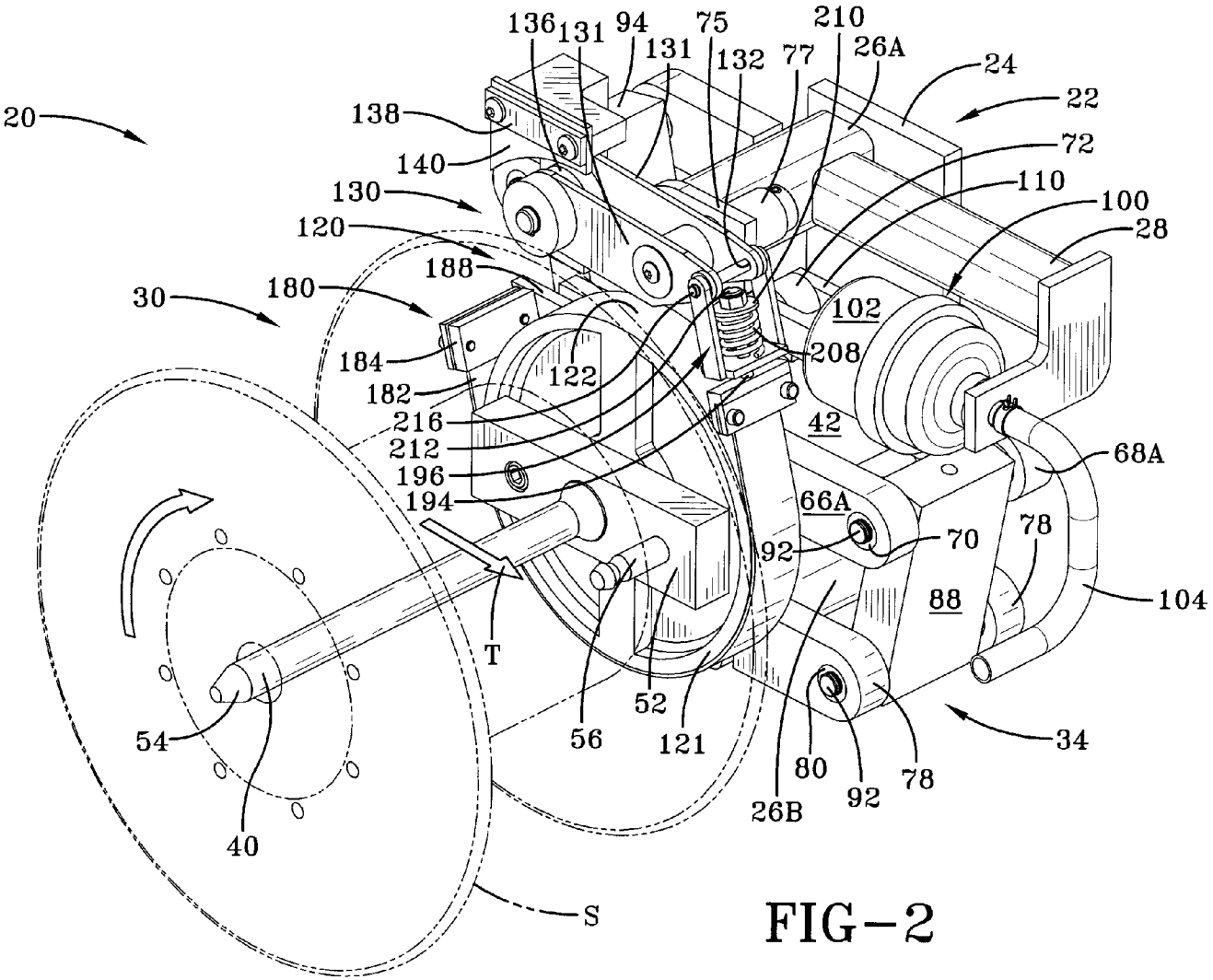
FIG. 2 is a front isometric view of the tension control device shown in a non-braking position.
Figure 3:
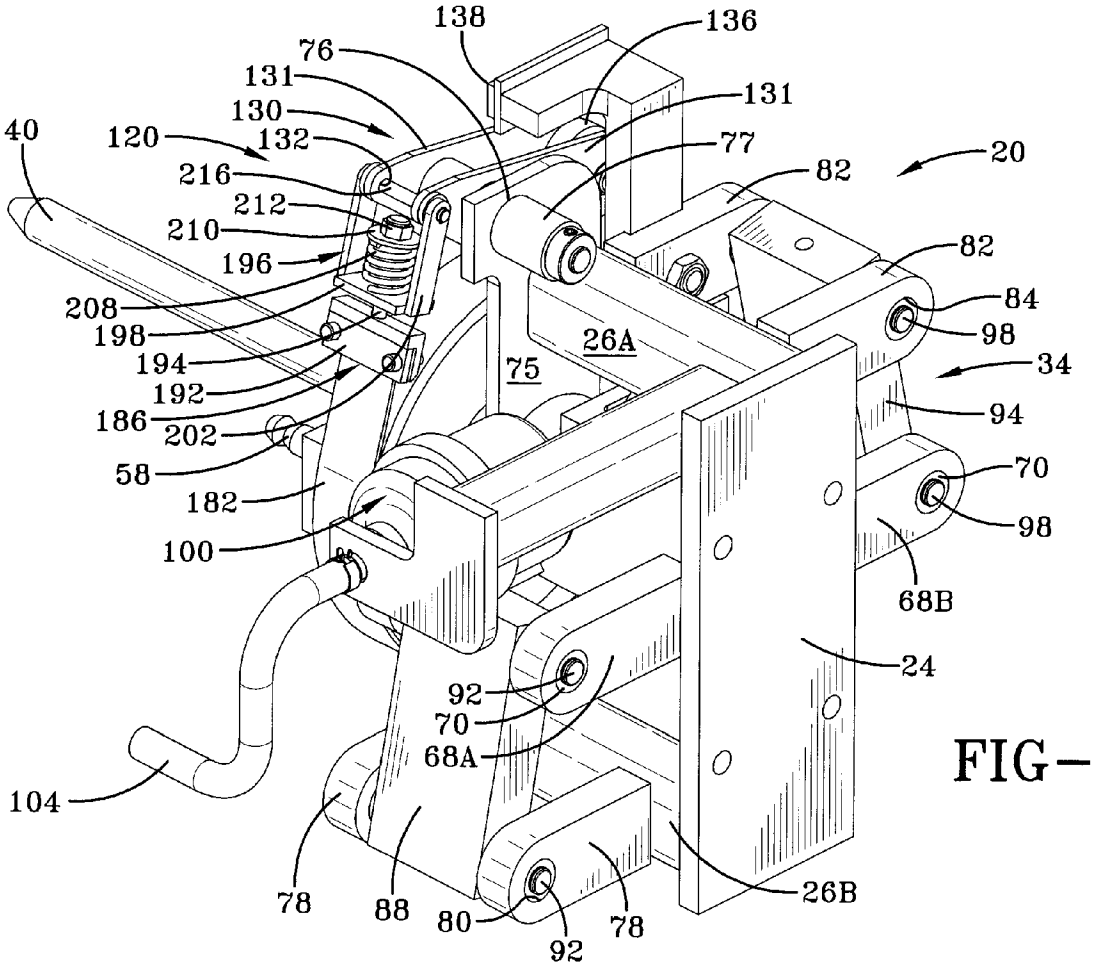
FIG. 3 is a rear isometric view of the tension control device shown in a braking position.
Figure 4:
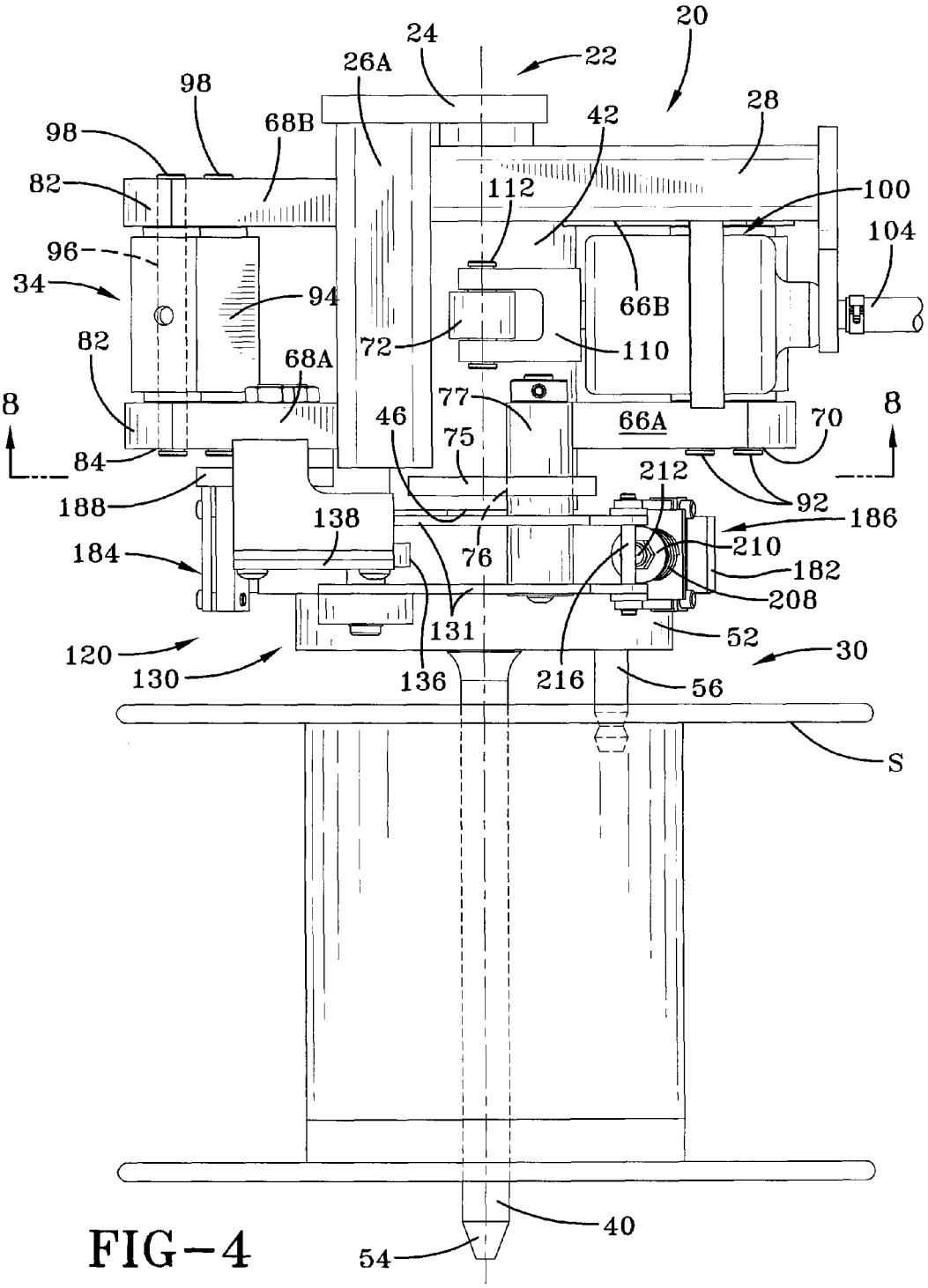
FIG. 4 is a top view of the tension control device.

A cam bracket 138 is fixed and secured to an upper tab 82 of the straight-line mechanism. The bracket 138 provides an inverted cam surface 140 which is curvilinear and which is engaged by the cam roller 136. Accordingly, as the carriage moves from side to side, the roller 136 travels along the cam surface 140. Skilled artisans will appreciate that side to side movement of the straight line mechanism 34 results in a slight swinging motion. Although the spindle 40 always moves in a straight line, the mechanism 34 swings slightly upward and downward at the link arm connections. In view of this upward swinging motion, the inverted cam surface 140 provides an appropriate curvilinear surface to ensure controlled tension of the filamentary material. When a tension is applied to the filamentary material and is sufficient to overcome the biasing force provided by the loading assembly 100, the carriage is placed in an intermediate, partially loaded position as shown in FIG. 2.

In operation, after spool S is loaded onto the spindle assembly 30, and air pressure is applied to the loading assembly 100, the tension control device is ready to operate. The air pressure applied to the loading assembly 100 is such that the force delivered by loading assembly 100 is substantially equal to the withdrawal tension desired. Initially, the straight-line mechanism 34 is biased by a force from the loading assembly 100 such that the roller 136 is moved downwardly along the cam surface 140 such that a braking force is applied. Initially or when the tensioning force of the filamentary material is suddenly released or is insufficient to overcome the loading force, then the carriage assembly moves away from the applied force and the cam roller 136 moves downwardly along the curvilinear cam surface 140. As this occurs, the rocker arm 130 pivots downwardly at the pivot pin 77 forcing the U-bracket 196 upwardly along the stem 194 so as to compress the spring 126 and force the friction band to exert a braking force on the brake drum braking surface 122. In particular, as the rocker arm 130 is forced to pivot in a counter-clockwise manner, the U-bracket compresses the spring 208 and gradually exerts a pulling force on the friction band 182. Compression of the spring 208 is limited by the length of the sleeve 206. In other words, as the base of the U-bracket 196 is pulled upwardly, the spring is gradually compressed until such time that the spring is compressed to an equivalent height of the sleeve 206. At this stage, a full force is exerted by the friction band on to the braking surface 122. This force is maintained until the loading assembly 100 is overcome by the tension force of the filamentary material. The braking force is transmitted through the brake drum, the drive plate 52 and the drive pin 56 so as to control rotation of the spool. Indeed, the braking force slows rotation of the spool and slows or stops when withdrawal of the filamentary material slows or stops. The tension created in the filamentary material opposes the bias force of the loading assembly resulting in the movement of the straight-line mechanism (with spindle assembly 30 and spool S) out of or away from the upper portion of the cam surface 140 until the tension force of the filamentary material is substantially in balance with the force of the loading assembly 100. In other words, the filamentary material is allowed to payout or be withdrawn at a regulated rate when the biasing force exerted by the loading assembly or other force provided by configuration of the device 20 is equivalent to or balanced with the tension force applied to the filamentary material. As these forces counteract one another, the spindle assembly linearly moves in relation to the fixed support. In most embodiments the linear movement will be substantially horizontal, but could be in other orientations depending upon how the spindle assembly is oriented with respect to the fixed support.

If the speed of withdrawal of the filamentary material is changed or if the diameter of the wound material on the spool is changed, the movement of the straight-line mechanism (with spindle assembly 30 and spool S) adjusts automatically to the force delivered by the loading assembly 100 as long as the force of the loading assembly is within the operating limits of the device. To change operating tension of the filamentary material, it is only necessary to change the pressure applied to the loading assembly 100, or change the biasing force in another manner as appropriate.

Obviously, when the withdrawal speed is stopped, withdrawal tension falls to zero because spool S and spindle assembly 30 with brake drum 121 no longer rotate, and no friction force or retarding drag is generated. In other words, when the withdrawal speed is slowed, the tension force is reduced and unable to overcome the biasing force, and then the cam roller 136 moves toward and along the down-sloping curvilinear cam surface 140 resulting in application of braking force by the friction band 182 on the braking surface 122.

Skilled artisans will appreciate that the straight-line mechanism eliminates the effect of gravity except for the friction, which varies according to the weight of the spool, but is negated by the use of anti-friction bearings in the joints. This embodiment is further advantageous in that the need for a control arm is eliminated, thus avoiding potential problems with wear on a control arm used in the prior art and tangling of filamentary material that is laced through the control arm. Moreover, elimination of the control arm significantly reduces the overall size of the device 20. This allows for more devices to be placed on a creel, or allows for an equivalent number of devices to be placed on a smaller size creel. This saves room on a factory floor, thus allowing for improved work flow and other benefits. Additionally, the spools are easier to load as the upper rows of the creel are reduced in height.

Referring now to FIGS. 9-16, it can be seen that an alternative embodiment of the tension control device is shown. In this embodiment the straight-line mechanism is replaced with a linear ball bushing mechanism which also allows for linear movement of the carriage assembly based upon the pull-off forces exerted by the filamentary material. Other than the specific operational features of the ball bushing mechanism replacing the straight-line mechanism, the alternative embodiment operates in substantially the same manner. And all of the parts are substantially the same except for replacement of the straight-line mechanism. Where appropriate, the same identifying numerals are used for the same components and those features are incorporated into the present embodiment. In this embodiment, the device 150 includes a support frame 152 which carries a linear ball bushing mechanism designated generally by the numeral 153. The support frame is fixed to the creel structure as in the previous embodiment. A pair of spaced apart support arms 154 and 160 extend from the support frame 152 in a substantially perpendicular and spaced apart manner Each support arm 154,160 has at least one opening and in the embodiment shown a pair of rail openings 156 and 162, respectively, that are aligned with one another.

A diaphragm actuator bracket 158 extends from the support arm 160 and carries the loading assembly 100 which operates as described in the previous embodiment. However, in this embodiment the loading assembly 100 is coupled to an underside of the carriage. A brake bracket 164 extends from a carriage 170 and carries the braking mechanism 120. In this embodiment, the flange 188 extends from the bracket 164 and carries the fixed end clamp 184.

In this embodiment a carriage 170 is employed which is slidably mounted upon slide rails 172 that extend between the support arms 154 and 160. Specifically, the slide rails 172 are carried and mounted in the rail openings 156 and 162. The carriage 170 includes two pairs of carriage bushings 174 that are mounted to a topside thereof and which slidably receive the slide rails 172. In other words, one pair of carriage bushings 174 is associated with each of the slide rails 172. Of course, any number of carriage bushings can be associated with each slide rail. As such, the carriage 170 moves linearly along the slide rails 172 depending upon the tension force applied by the filamentary material and the biasing force applied by the loading assembly 100. And in this embodiment, the cam bracket 138 is fixed and secured to one of the support arms 154.

As will be appreciated upon viewing FIGS. 9-16, the brake drum is carried by and rotates as the spindle rotates and is mounted in proximity to a spool end of the carriage. Moreover, the brake mechanism 120, including the brake friction band, is mounted proximal the drive plate 52. Skilled artisans will appreciate; however, that the braking mechanism 120 could be placed on the other side of the carriage 170 if desired, as long as the brake drum 121 is likewise moved to the same side of the carriage.

Operation of the ball bushing embodiment of the device 150 is similar to that of the device 20 and those operational features are adopted. As a tension force is initially applied to the filamentary material, the loading assembly 100 or other structural feature exerts a bias force to maintain the carriage 170 and the brake drum 121 in close proximity to the braking mechanism. As the biasing force is overcome, the tension on the filamentary material pulls the spindle assembly away from the brake mechanism 120 in a substantially horizontally and linear direction and the spool is allowed to rotate with a reduced brake force applied. In the event the tension or force on the filamentary material is suddenly released and the spool continues to rotate, then the loading assembly 100 pushes the carriage assembly 170 horizontally and linearly back toward the braking mechanism. As a result, the roller 136 is moved downwardly along the substantially linear cam surface 140'. In this embodiment the cam surface is substantially linear, as opposed to curvilinear in the other embodiment, in view of the fact that the carriage 170 can only move linearly along the slide rails. In any event, pivoting of the rocker arm 130 results in movement of the brake band into engaging contact with the braking surface 122. At this time, friction band 182 engages the braking surface 122 and a corresponding braking force is generated so as to slow or stop the rotation of the spindle and accordingly the spool.

It will be appreciated that the device 150 has many of the same benefits and advantages of the device 20. Although the ball bushings are of low friction, they do have sufficient friction to interfere with the function of heavy spool loads in view of the deflection of the slide rails. However, the device may be beneficial for use with light weight spools of filamentary material.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A self-compensating tension control device for regulating the withdrawal of filamentary material from a spool, comprising:

a fixed support, said fixed support maintaining a cam surface;

a spindle assembly carried by said fixed support, said spindle assembly rotatably carrying the spool of filamentary material a mechanism coupling said fixed support to said spindle assembly to allow said spindle assembly to move substantially horizontally and linearly depending upon a tension force applied to the filamentary material, in opposition to a biasing force, which causes said spindle assembly to linearly move in relation to said fixed support; and a braking mechanism comprising a brake drum rotatable with said spindle assembly, a friction band adapted to engage said brake drum, and a rocker arm having a cam roller engageable with said cam surface at one end and at an opposite end a bracket associated with said friction band, wherein when the tension force applied to the filamentary material is reduced and unable to overcome the biasing force, said cam roller engages said cam surface and causes said bracket and said friction band to generate a braking force on said brake drum, and wherein withdrawal of the filamentary material at a regulated rate occurs when the biasing force is balanced with the tension force.

2. The device according to claim 1, wherein said mechanism comprises:

a straight-line mechanism coupling said fixed support to said spindle assembly.

3. The device according to claim 2, wherein said spindle assembly comprises a spindle rotatably received within a carriage, said carriage having a pair of spaced apart carriage arms extending radially from opposite sides of said carriage, each said carriage arm having a carriage arm hole therewith, and wherein said fixed support comprises:

a support frame;

an upper support arm extending from one side of said support frame; and a lower support arm extending from another side of said support frame;

each said support arm having spaced apart arm tab holes aligned with each other.

4. The device according to claim 3, wherein said straight line mechanism further comprises:

a first link arm pivotably connecting said upper support arm with one said pair of said carriage arms; and a second link arm pivotably connecting said lower support arm with the other of said pair of said carriage arms.

5. The device according to claim 4, wherein said carriage rotatably carries said brake drum and has a spindle end from which extends said spindle, said spindle end having a drive pin extending in the same direction as said spindle, said drive pin adapted to be engaged by the spool such that rotation of the spool causes rotation of said brake drum.

6. The device according to claim 5, wherein said cam surface is curvilinear.

7. The device according to claim 2, further comprising:

a loading assembly mounted to said fixed support and coupled to said spindle assembly so as to impart the biasing force to said spindle assembly and move said cam roller into engagement with said cam surface.

8. The device according to claim 1, wherein said mechanism further comprises:

a ball bushing mechanism coupling said fixed support to said spindle assembly.

9. The device according to claim 8, wherein said spindle assembly comprises a spindle rotatably received within a carriage, said carriage having at least one carriage bushing mounted thereto, and wherein said fixed support comprises opposed support arms, each support arm having at least one rail opening aligned with one another, and at least one slide rail having opposed ends received in said rail openings.

10. The device according to claim 9, wherein said at least one slide rail is slidably received in said at least one carriage bushing.

11. The device according to claim 10, wherein said brake drum and said spindle extend from said carriage, said carriage also maintaining a drive pin extending in the same direction as said spindle, said drive pin adapted to be engaged by the spool such that rotation of the spool causes rotation of said brake drum.

12. The device according to claim 11, wherein said cam surface is linear.

13. The device according to claim 8, further comprising:

a loading assembly mounted to said fixed support and coupled to said spindle assembly so as to impart the biasing force to said spindle assembly and move said cam roller into engagement with said cam surface.

* * * * *